US005567066A

United States Patent [19]

Paranjpe

[11] Patent Number: 5,567,066

[45] Date of Patent: Oct. 22, 1996

[54] NONIMPACT PRINTER WITH READ AND WRITE SYSTEMS FOR MONITORING RIBBON USAGE

[76] Inventor: Suresh C. Paranjpe, 5625 Summit Dr., W. Linn, Oreg. 97068

[21] Appl. No.: 236,423

[22] Filed: May 2, 1994

Related U.S. Application Data

[63] Continuation-in-part of Ser. No. 73,169, Jun. 7, 1993, abandoned, which is a continuation-in-part of Ser. No. 57,538, May 4, 1993, abandoned, which is a continuation-in-part of Ser. No. 47,144, Apr. 12, 1993, which is a continuation-in-part of Ser. No. 39,871, Mar. 30, 1993, Pat. No. 5,445,463.

[51] Int. Cl.[6] ..... B41J 35/36

[52] U.S. Cl. ..... 400/249

[58] Field of Search ..... 400/249, 240, 400/240.4

[56] References Cited

U.S. PATENT DOCUMENTS 4,630,069 12/1986 Erlichman ..... 346/76

4,797,016 1/1989 Lahr ..... 400/249

FOREIGN PATENT DOCUMENTS 235181 10/1986 Japan .

257674 10/1988 Japan .

023364 1/1990 Japan .

155124 6/1993 Japan ..... 400/249

OTHER PUBLICATIONS

05–155124 Inoue, Jun. 1993. English translation of JP 05–155124.

*Primary Examiner*—Ren Yan

*Attorney, Agent, or Firm*—Marger Johnson McCollom & Stolowitz, P.C.

[57] ABSTRACT

A nonimpact printer minimizes ribbon wastage by recording on each ribbon its usage history and then using that history to control subsequent ribbon movement in the same or a different printer. The usage history is printed onto the ribbon itself, and is thus portable along with the ribbon cassette. Sequence numbers that identify particular panels and portions thereof are similarly written onto the ribbon for greater convenience in ribbon control.

13 Claims, 4 Drawing Sheets

NONIMPACT PRINTER WITH READ AND WRITE SYSTEMS FOR MONITORING RIBBON USAGE

RELATION TO OTHER APPLICATIONS

This application is a continuation-in-part of application Ser. No. 08/073,169 filed Jun. 7, 1993, now abandoned, which is a continuation-in-part of application Ser. No. 08/057,538 filed May 4, 1993, now abandoned, which is a continuation-in-part of application Ser. No. 08/047,144 filed Apr. 12, 1993, which is a continuation-in-part of application Ser. No. 08/039,871 filed Mar. 30, 1993, now U.S. Pat. No. 5,443,463.

BACKGROUND OF THE INVENTION

1. Field of the Invention

This invention relates to an image forming apparatus (nonimpact printer) that uses an ink or dye ribbon, including electroresistive ribbon types, and one or more forms of energy to cause the transfer of a selected portion of ink or dye or the like to a substrate to prepare (i.e., precoat) that substrate for subsequent image formation, to overcoat an image already formed, to form an image directly, or to form an intermediate image for subsequent transfer to form a permanent image. More precisely, this invention relates to printing devices that employ ribbons having ink or dye panels thereon of types that are adapted to carry out the various printing tasks described, and to read/write means for (1) recording on such ribbons which of the included panels or parts thereof have previously been used; and (2) reading such ribbon usage data so that unused panels or portions thereof may be searched out for use, thereby minimizing wastage of ribbon.

2. Background Information

In Applicant's previous application Ser. No. 8/039,871 filed Mar. 30, 1993, there were disclosed a variety of "combination" ribbons (or "transfer media") that included thereon ink or dye panels appropriate to carrying out pre-coating, over-coating, and nonimpact printing both on temporary and permanent substrates. Included in that disclosure is a description of means for recording the usage of such ribbons, specifically, by (1) maintaining an electronic record of the ribbon position at all times, based upon the pre-printed disposition on such ribbons of several types of position markers; and (2) maintaining a record of those times (and ribbon positions) at which some printing process was carried out, e.g., by recording an "up" or "down" position of the print head or the like, by providing a printing "flag" in the print data generator (whereby that flag would be sent to the printer controller for recording), or by similar means. It was also shown how the usage data so generated can be maintained within the memory of the printer itself, or for "portability" purposes that "usage map" can also be transferred to a memory chip incorporated within the ribbon cassette. The process requires for its implementation a printer that includes appropriate data processing and digital memory means, and as noted the ribbon cassette must also include memory if the usage data pertaining to that particular cassette are to accompany it from one printer to another.

SUMMARY OF THE INVENTION

As an alternative to the foregoing procedure that may provide some economic advantage, the present specification sets forth means for recording usage data directly on the ribbon material itself, and thereafter reading the same in the course of further use of the ribbon, without the need for digital processing. Of course, if a ribbon is not removed from the printer, the aforementioned digital memory means, if present within the printer, can be used as well in the manner described in the parent application. At the same time, the present invention provides means for recording that usage data on ribbon cassettes that do not include a memory chip, or in printers that have no provision for such data transfer to such a cassette chip.

The invention comprises a nonimpact printer which includes means for identifying instances in which some printing process was carried out using a particular ribbon, and a write system that records on the ribbon material itself the fact that such printing had occurred. At a later time, a read system provides readings of the information so stored on the ribbon, and thus identifies to the printer which ribbon panels or portions thereof remain available for use in printing.

For such purposes, in one embodiment of the invention the ribbon is provided with additional fields into which the write system can write into a newly installed ribbon the kinds of sequence numbers that were described in the earlier application as having been pre-recorded thereon. As the ribbon is used, those sequence numbers are correlated with actual ribbon usage in a usage map. At a later time (e.g., after the printer has been turned off and is turned back on, as on a following day) the ribbon controller initiates ribbon movement during which time the sequence numbers that were so recorded are being read, and in conjunction with the usage map that has been maintained in memory is able to move the ribbon to those panels or portions thereof that have not yet been used.

In a second embodiment of the invention, the printer employs a ribbon onto which such sequence numbers have already been recorded (as in the parent application), but instead of (or in addition to) recording usage data in memory, the write system records onto the ribbon itself, in a field similar to that of the previous embodiment, a mark at those places where the ribbon has been used. Such marks can be used to verify the data recorded in the usage map, or in the event that no such map has been recorded in memory (e.g., in a printer lacking such digital processing means), the marks themselves provide the means (again through the read system) for tracking through the ribbon to locate unused panels or portions thereof. If a ribbon is removed from the printer and replaced with a different ribbon, the newly installed ribbon will almost certainly not have the same usage history as the ribbon that was removed (and to which the usage map then remaining in the printer will pertain), hence the marks on the newly installed ribbon when noted by the read system serve to "instruct" the printer not to employ that usage map but to obtain its usage data instead from the ribbon itself, i.e., by moving the ribbon and reading the marks that indicate which panels and panel portions of the ribbon have been used.

Further with regard to this embodiment, if the ribbon selected for use does not incorporate sequence numbers as previously described (and unlike the preceding embodiment there are no means for writing such numbers onto the ribbon), unused ribbon panels or portions thereof can still be located but only by a time consuming search of the ribbon. (That is, with no sequence numbers to be read it is not possible to create a usage map that is available for quick reference.) Therefore, it is preferable to employ the preceding embodiment of the invention in which sequence numbers are written to the ribbon by the printer or, when using a printer in which the writing of sequence numbers is not possible, only to use ribbons that have such sequence numbers pre-recorded thereon.

For reference purposes, the following section sets out the particular terminology in which the invention will be described:

TERMINOLOGY

Energy Source: A source of a form of energy (light or heat) including a laser, a conventional thermal transfer print head, and the like.

Transfer material: A substance place on a medium for the purpose of being transferred therefrom to a substrate by the application thereto of one or more forms of energy in order to form an image on the substrate.

Printer: An apparatus that employs an energy source to apply one or more forms of energy to a transfer material in order to form an image on a substrate, including a printer, a FAX, the printing portion of a copier, or the printing portion of any other like device that functions as stated.

Technology: A particular method of transferring an image from a medium to a substrate using one or more forms of energy, including those in which the transfer material comprises thermal transfer ink, dye diffusion (also called "sublimation") dye, electroresistive ink, combinations of chromogenic materials and encapsulated radiation curable compositions, combinations of a developer and a photosensitive microencapsulated material, materials subject to transfer when acted upon by light (including laser light), and materials in which either or both light and heat cause changes in at least one of the group of physical parameters of said materials consisting of softening, melting and glass transition temperatures, rates of sublimation and of diffusion, and viscosity, as well as other methods and materials whether or not presently known or conceived.

Type: Variations in method within a particular technology, such as the use of different thermal transfer materials that require different temperatures or the like for transfer to occur.

Class.: A subset of transfer materials within a particular technology, e.g., precoat, overcoat and colored ink comprise three classes of thermal transfer materials (of the same or different types).

Panel: A single continuous region on a medium that has had a single class of transfer material, and in a single color (where applicable), applied thereon.

Set: A collection of one or more panels that are contiguous (or nearly so) and fall within a particular class, e.g., a set of yellow, magenta and cyan (y, m, c) color thermal transfer panels.

Group: A collection of panels, or sets of panels, that fall within a single technology, e.g., a set of y, m, c panels, a black panel, and one or more panels of precoat or overcoat that all transfer by means of a single type of thermal transfer.

Read system: A system adapted to detect a form of energy from a medium in a particular pattern by reflection, a magnetic field, or by other means, wherein said energy pattern is disposed in a predetermined manner so as to convey information to the read system.

Write system: A system adapted to transmit a form of energy onto a medium so as to change a detectable characteristic of that medium in a predetermined pattern, whereby the pattern so produced provides a desired record of information on that medium.

Marking field: A region on a medium that has been especially adapted, or at least is used, for the purpose of receiving information from a read/write system and thereafter providing readings of that information to such a read/write system. The marking field can be disposed either within or outside of the areas of the medium on which transfer materials have been disposed, and the information recorded within the field can have been placed thereon either during the course of manufacture of the ribbon or during periods of use of the ribbon within a printer.

BRIEF DESCRIPTION OF THE DRAWINGS

The preferred embodiments of the invention will now be described in detail with reference to the accompanying drawings, in which.

DETAILED DESCRIPTION OF THE INVENTION

Figure 1A:
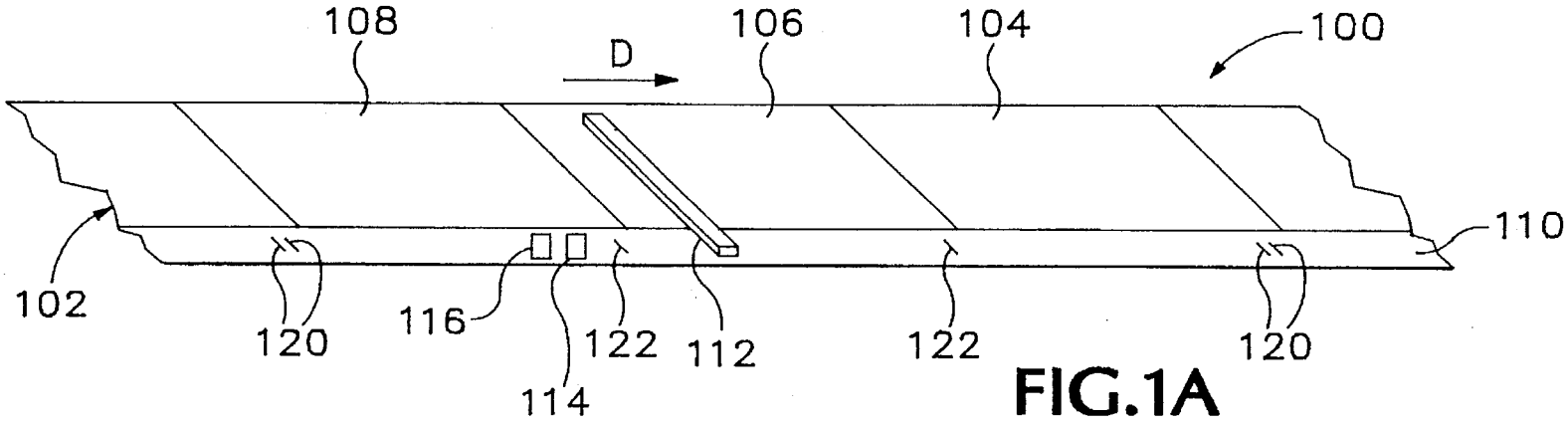
FIG. 1A shows a perspective view of a printer ribbon including panel markers and a print head that extends beyond the printing region into the panel marker region.

An exemplary ribbon and print head combination that exhibits the principal feature of the invention as to the ribbon itself is shown in FIG. 1A, wherein ribbon 100 has a substrate 102 onto which have been disposed a number of ink or dye panels 104, 106, 108 which may, e.g., constitute respective yellow, magenta and cyan thermal transfer color panels. Disposed along one side of substrate 102 is a marking field 110 that is placed thereon at the time of manufacture of ribbon 100, and comprises a coating of material that, like panels 104, . . . , 108, responds to the application thereto of a form of energy such as heat, light or a magnetic field. In this case, however, the pattern of energy so imposed is not for the purpose of transferring an image from ribbon 100, but rather to record desired information onto ribbon 100. Thus, the material of marking field 110 should respond to an imposition of energy as stated, but should not cause the transfer of ink or dye therefrom. The information so conveyed in this aspect of the invention lies in identifying which portions of ribbon 100 (i.e., which panels such as panels 104, 106, 108, etc., and which portions of those panels) have been used for printing.

More exactly, FIG. 1A further shows a print head 112 which, it may be noticed, extends beyond the transverse extension of color panels 104, 106, 108, etc. to be disposed also over the region of marking field 110. Using a thermal transfer print head as an example, it is known that such devices incorporate a series of writing elements that, when heated, will cause the transfer of ink from media such as any of the panels 104, 106, 108, etc. of ribbon 100 onto an underlying substrate. It is also known to use an OR gate to generate a separate signal at any time that any one of the series of such elements that extends length-wise along the print head has been activated, i.e., the print head has been used for printing. By connection of such an OR gate between the signal lines that operate the thermal elements disposed over the color panels (and are thus used for printing) and another group of thermal elements disposed over marking field 110, the material of marking field 110 will then exhibit in some way the fact that such energy was received at the former group of elements. Thus, any use of ribbon 100 for printing at some particular location will correspondingly place a mark in marking field 110 at the same longitudinal location therealong. A sensor (e.g., a simple LED 114 and photodetector 116 arrangement as shown in FIG. 1A) disposed above marking field 110 can then detect by a change in the reflective properties of marking field 110 that the portion of ribbon 100 in question has been used. A magnetic detector or similar means (which corresponds to the means by which the marks are made in marking field 110) can also be used. By using the methods of ribbon control described hereinafter, the printer can be instructed to bypass those regions of ribbon 100 that are thus shown to have been used, and to continue traversing through ribbon 100 until an unused portion is found.

However, it will be shown below that in a preferred embodiment of the invention, marking field 110 or the equivalent can also be used for other purposes, specifically, to provide encoded markings that identify the characteristics of the ribbon as a whole, the particular location of the ribbon at any time through sequence markings, the nature and identity of the particular panel that at the moment lies under the print head, and so on. Therefore, use of the procedure just described must in such a case take account of the presence within marking field 110 of other marks. Thus, other methods to be noted below may be used, or the procedure as described above can be carried out, e.g., by recording such usage data along a different path (i.e., a different distance from the edge of ribbon 100) within marking field 110, or by providing a separate marking field (not shown) for usage data on the opposite side of ribbon 100 from marking field 110.

Figure 1B:
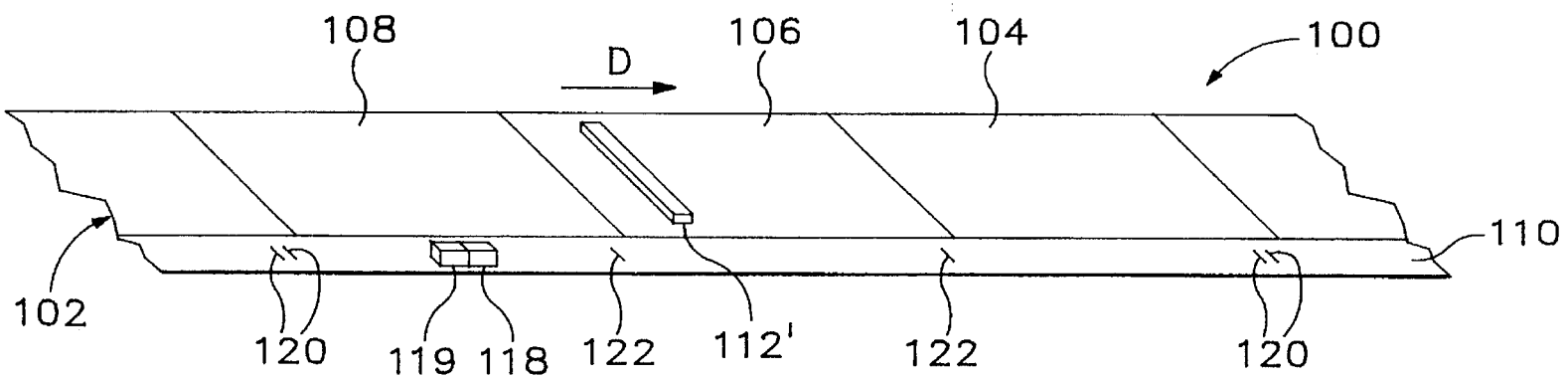
FIG. 1B shows a perspective view of a shorter print head that is confined within the printing region, and also a write head for writing within the panel marker region.

As shown in FIG. 1B, in a preferred embodiment the device incorporates a separate write head 118 and an associated read head 119 disposed above marking field 110 at a point prior to print head 112', by which is meant that every point on a ribbon 100 moving in the direction of arrow D will pass under write head 118 and read head 119 before passing under print head 112. By the use of a separate write head 118 it becomes possible to use a shorter and less expensive print head 112' as shown in FIG. 1B, since the latter now need not extend over marking field 110. As noted above, for writing by thermal means the material of marking field 110 will preferably be of a type such as the thermal paper used in many FAX machines that responds to heat or light, etc., but by means, e.g., of a change in color and not a loss of material.

Write head 118 of an optically readable embodiment may comprise a separate thermal head or perhaps a group of semiconductor laser diodes. In either case, in order for the mark that is to indicate ribbon (or panel, etc.) usage to be easily detected, it is preferable that write head 118 form a mark on marking field 110 of significant size and in a distinctive pattern, e.g., as in a 20×20 dot matrix, or preferably at least 20 dots in one dimension and more than 20 dots in the other dimension.

An additional aspect of ribbon 100 in FIGS. 1A and 1B lies in the two types of marks 120 (double) and 122 (single) shown in FIGS. 1A, 1B to be disposed lengthwise along and within marking field 110 at fixed relationships to the start of each of panels 104, 106, 108. It is well known, in the case that ribbon panels have been divided into sets, e.g., of yellow, magenta, and cyan, to use such marks to indicate by a double mark the start of such a three-panel set, and then to use a single mark to indicate the start of each of the panels that is not also the first panel in a set (of which in this example there would be two). In the example of FIGS. 1A, 1B, therefore, assuming that the aforesaid color sequence was employed, panels 104, 106, 108 would be identified respectively as yellow, magenta, and cyan.

A preferred apparatus for writing usage marks onto the ribbon and for reading the same thereafter is shown in greater detail in FIGS. 2(A and B), which is an adaptation of FIG. 12 of the parent application so as to incorporate the apparatus and associated electronics of the present invention. (The cassette system of the parent application is not shown. Also, a method of numbering the components of FIGS. 2(A and B) that is analogous to that used in the parent application is used, i.e., the parent application uses a 9xx series while FIGS. 2(A and B) uses a 2xx series. One consequence is that corresponding elements within FIGS. 1(A and B) and 2(A and B) herein will have different numbers, but to a minimal extent so that there should be no confusion.)

Specifically, ribbon control system 200 comprises an electronic system 220, a printer control system 230, a read system 240, and a write system 280. Electronic system 220 further comprises microprocessor 222, memory 224 (which can include both RAM and ROM), and user interface 226, all of which are connected to common bus 228. Except where otherwise stated with reference to some particular aspect of the invention, the various components of electronic system 220 are entirely conventional in nature and will not be additionally described.

Figure 2A:
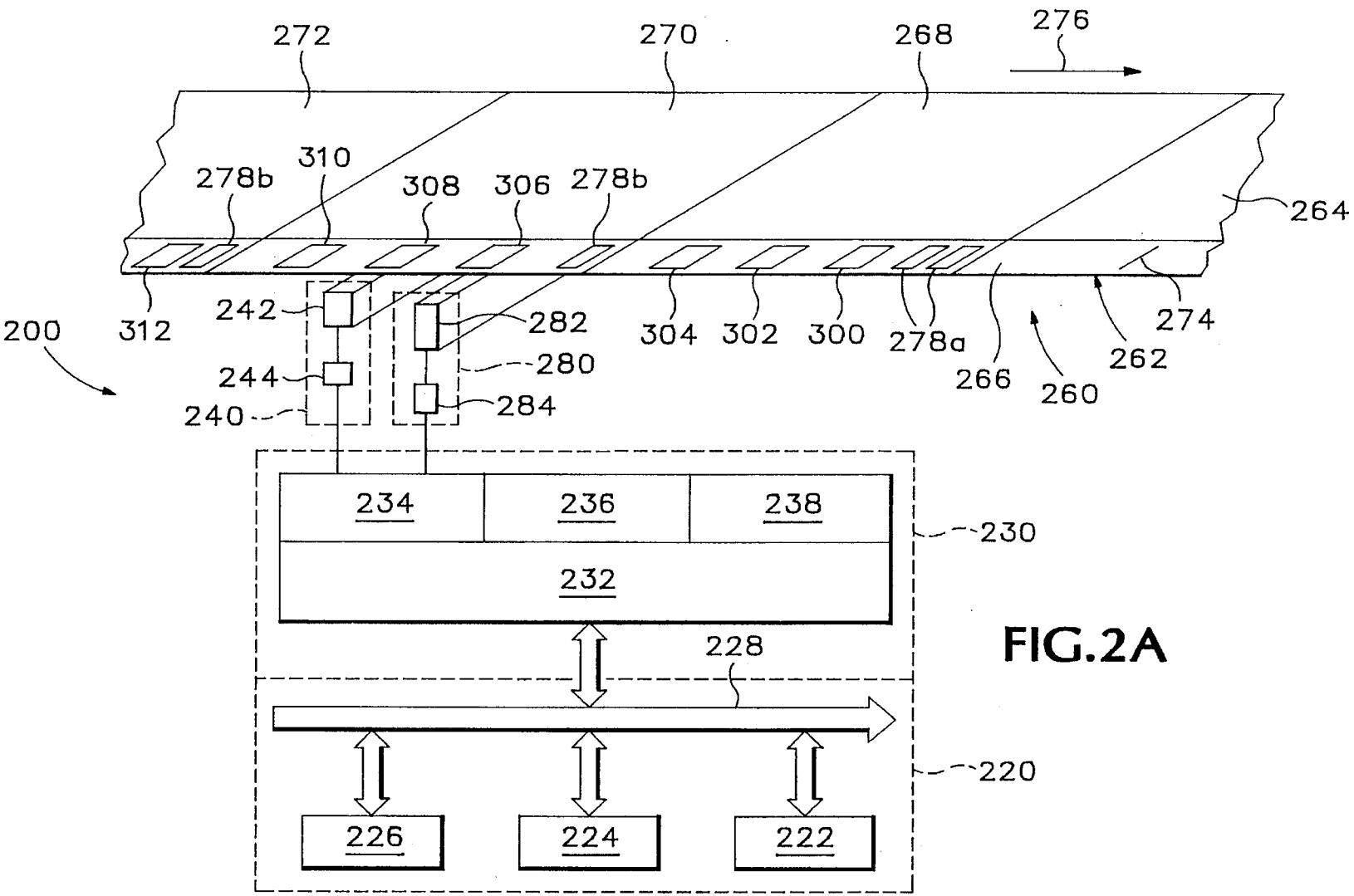
FIGS. 2(A and B) show in block diagram a printer that incorporates the read/write system of the invention, and also in perspective view (in FIG. 2A) a ribbon that incorporates the marking fields of the invention.

Printer control system 230 connects with electronic system 220 through bus 228 as shown in FIG. 2A, and further comprises controller 232 which connects with each of ribbon control 234, print control 236 and substrate control 238. Through ribbon control 234, printer controller 232 acts to move the ribbon to desired locations and to accept ribbon and position information therefrom as will be described below. Through print control 236, printer controller 232 acts to transmit print data (and indicate to ribbon control 234 when printing has occurred) and to raise and lower the energy source (where necessary, as with a thermal print head). Through substrate control 238, printer controller 232 acts to advance the image receiving substrate through such means as were described in the parent application. The printer operator is enabled to monitor and control all of such operations by interface 226 which may, e.g., be a conventional set of push buttons and LEDs or the like. Memory 224 serves to accumulate data as to the nature of the installed ribbon and the portions thereof that have been used (i.e., "usage data"). Through common bus 228, and on the basis of instructions received from the operator by way of interface 226, microprocessor 222 executes control of the aforesaid functions in the usual manner.

Read system 240 provides means for reading double and single marks such as marks 120, 122 of FIGS. 1A and 1B as well as usage marks as will be described in connection with FIGS. 2(A and B). Such a system would conventionally employ a light source, sensor, amplifier, A/D converter and register. In the parent application, a read system was described in terms of a bar code scanner and digitizer. The embodiment of FIGS. 2(A and B), however, illustrates the invention through the use of magnetic means to communicate information concerning the ribbon and the accumulated usage thereof.

Figure 2B:
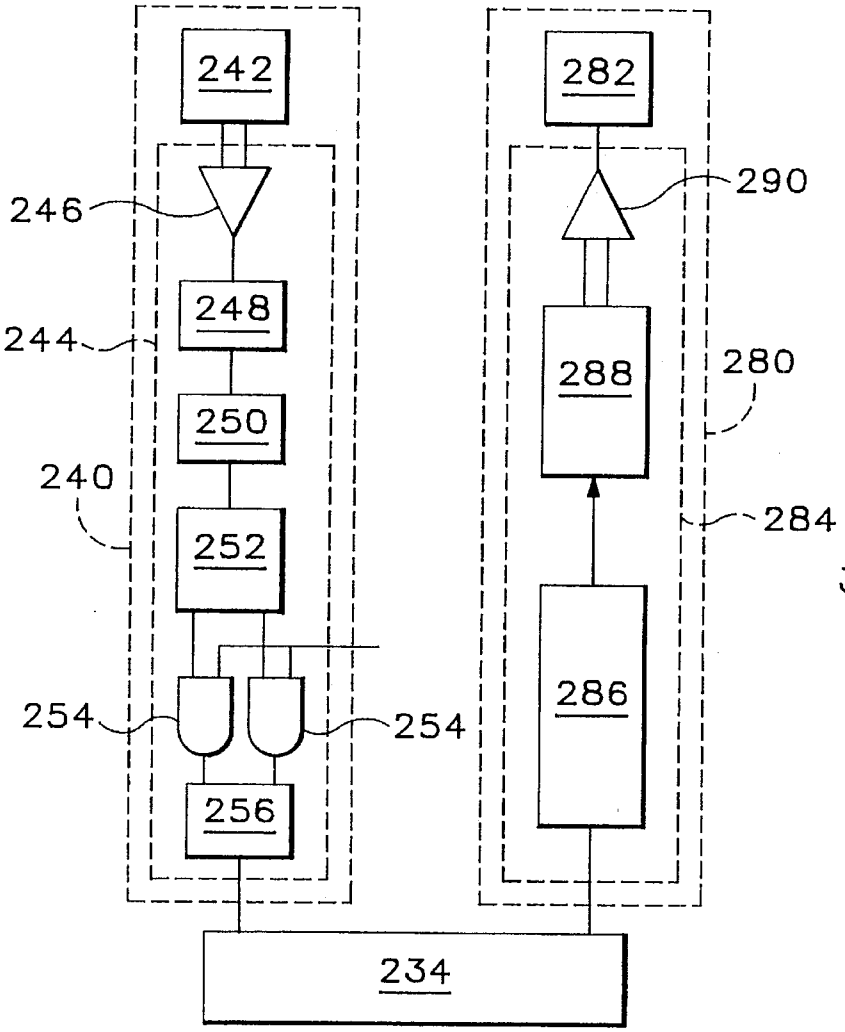

More specifically, read system 240 comprises a magnetic sensor 242 that connects through read control 244 to ribbon control 234. As shown in FIG. 2B, read control 244 further comprises at the input from magnetic sensor 242 an amplifier 246 connected to a differentiator 248, a filter 250 on the output of differentiator 248, a pulse generator 252 leading from filter 250, two AND gates 254 0 leading from pulse generator 252, and finally a register 256 leading from AND gates 254. This circuitry is analog in nature for the reason that the signal received by magnetic sensor 242 in passing by magnetically imprinted data within marking field 110 is analog in nature. The circuitry of read control 244 thus acts in essence as an A/D converter, in the sense that the analog signal first received by magnetic sensor 242 is amplified by amplifier 246, differentiated into a quasi-pulse by differentiator 248, and then filtered into a more "clean" pulse by filter 250. If necessary, filter 250 can be designed to distinguish the desired signal (i.e., either double or single panel markers, or usage data) from any other signals received by magnetic sensor 242 as a consequence of other information that may have been encoded into marking field 110. The resultant quasi-digital data then passes into pulse generator 252 which through AND gates 254 places a block of data into register 256 which indicates that the particular location on ribbon 100 of FIG. 1 (and similarly on ribbon 260 in FIG. 2A) has been written to (as will be discussed below).

Read system 240 functions in relation to an installed ribbon 260, which is the kind shown in FIGS. 1A, 1B and generally one of the "combination" ribbons described in the parent application. Ribbon 260 is further shown conceptually in FIG. 2A as having a base 262 including a leader region 264 and a base strip 266 onto which deposited Color panels 268, 270, 272 or shorter dimension than the width of base 262. (Panels 268, 270, 272 are analogous to panels 104, 106, 108 of FIGS. 1(A and B), and for present purposes base strip 266 is analogous to marker region 110 of FIGS. 1(A and B).)

In base strip 266, marking fields 300, 302, 304 for panel 268 and 306, 308 and 310 for panel 270 are coating of magnetic, heat or light sensitive material. Panel markers 278*a*, 278*b* are also in the base strip 266.

In leader region 264 of base 262 and (in FIG. 2A) at one side thereof, and consistent with the disclosure of the parent application, ribbon 260 includes in magnetic code an identification marker 274 that identifies which one, of a number of ribbon varieties that the printer can accommodate, that the particular ribbon constitutes. Within the printer, memory 224 incorporates (e.g., within a ROM portion thereof) a pre-established look-up table that contains relevant information concerning that ribbon variety, and also concerning each of the other varieties of ribbon that the printer can accommodate, e.g., whether the ribbon employs conventional thermal transfer, dye diffusion or some other technology in which panels, how many panels it has, what are the colors, lengths, and relative disposition of each, and so on. On the basis of such information and correlated information preestablished within memory 224 (including the locations on the ribbons of each panel and the colors and dimensions of each, etc.), microprocessor 222 is enabled, e.g., to adjust through print control 236 the amount of force with which a print head should be urged against the ribbon, and the power labels, pulse widths and repetitions per pixel of the data signals to be sent to the particular type of energy source.

The thickness of ribbon over the width of the ribbon need to be uniform so that the ribbon is uniformly wound on the ribbon roll and there are no creases on the ribbon because of uneven diameter of the ribbon roll. The thickness of these marking fields 300, 302 etc. can be different than the panel of thermal transfer material coated on the base 262. For example, thickness of the thermal transfer material is 2 to 15 microns. If the thickness of the magnetic material is 4 micron and thickness of the Marking fields 300, 302 etc. is twice, then according to this invention the uncoated length between marking fields 300, 302 etc. is equal to the length of marking field 300, 302 etc. so that the average diameter of ribbon roll in the area of the marking field will be about same as average diameter of the ribbon roll where the panel exists.

In terms of ascertaining and controlling the location of ribbon 260 as it passes through the printer (in the direction of arrow 276), a series of double and single panel location marks 278*a* and 278*b* (corresponding to marks 120, 122 of FIGS. 1(A and B)) that would have been placed thereon at the time of manufacture is disposed along the side of base 262 bearing base strip 266 and which is aligned with read system 240 as shown in FIG. 2A. Marks 278*a*, 278*b* are shown in FIG. 2A as being disposed on the surface of ribbon 260 that is opposite read system 240 (i.e., on the top side of ribbon 260 rather than the under side), but since in this example marks 278*a*, 278*b* are magnetic they will be readable.

Again, panels 268, 270, 272 may, e.g., constitute the first of a number of sets of yellow, magenta and cyan color panels, and since FIG. 2A shows the particular part of ribbon 260 that is immediately after the leader 264, double and single marks 278*a*, 278*b* identify the panels as yellow (the first panel of the set as shown by double marker 278*a*, said set being established within the printer as actually being yellow, magenta and cyan by virtue of identification marker 274), and then as magenta and cyan (by the two panels single-marked by marks 278*b* following the double marked panel.) Such panel identification information is also passed through microprocessor 222 to memory 224 and is accumulated over time so as to establish the position of the ribbon at any particular time. (In the parent application, the information contained within a set of three corresponding marks (which were designated as 276*a*, 276*b* and 276*c* in that application) specifically identified the panel set, e.g., as: 276*a*—set 1, yellow; 276*b*—set 1, magenta; 276*c*—set 1, cyan.)

If the ribbon characteristics information is held in memory 224, upon read system 240 and memory 224 having established that ribbon 260 is at some particular location, if some other location is desired in order to carry out a printing operation that would not result from use of the ribbon as so positioned, the desired ribbon movement can be brought about through interface 226, either directly by the operator as in "go to panel set 100," or indirectly (through microprocessor 222 and memory 224) as in either "go to next black panel" or "print the next sequence in black" (using various pre-programmed and automated printing procedures). The location along ribbon 260 of that "next black panel" relative to the current location of ribbon 260 will also be stored within memory 224, having been ascertained from identification of the variety of ribbon actually present by way of identification marker 274, and then by the look-up tables previously mentioned, and microprocessor 222 then ascertains what that location is and instructs ribbon control 234 to move ribbon 260 accordingly.

Except for the method of reading marks on ribbon 260 as will be discussed below, the foregoing description is similar to that of the invention set forth in the parent application. As already noted and as shown in FIG. 2A herein, however, the present invention also includes within that printer structure a write system 280. Specifically, write system 280 comprises a write head 282 disposed on the "under" side of ribbon 260, analogous in that respect to the position of read system 240, but as shown in FIG. 2A at a point "downstream" therefrom so that as ribbon 260 moves in the direction of arrow 276, any particular portion thereof will pass by read system 240 before passing by write head 282. Write head 282 connects to write control 284 and thence to ribbon control 234.

Write system 280 may be designed to generate any kind of energy such as heat, light or a magnetic field, but for exemplary purposes (and to be consistent with the description of read system 240), write system 280 will be described in terms of a magnetic embodiment. In such case, marking field 110 of FIG. 1, which corresponds in position with what is described as base strip 266 of ribbon 200 in FIG. 2A, constitutes a magnetically sensitive stripe. In that case, at any time that printing occurs (as shown by use of an OR gate as previously described or on the basis of a secondary output from the original print data provided by print control 236), a signal is also sent to write head 282 by means of write control 284.

Write control 284 shown in FIG. 2B comprises, in connected sequence leading from ribbon control 234, a buffer register 286, a D-flip-flop 288, and a write driver 290 which leads into write head 282. Buffer register 286 acquires a write signal (i.e., a digital signal that printing is occurring) from ribbon control 234 which in turn receives the same in any convenient manner as mentioned above from the print head signal circuitry (not shown) and passes the same into D flip-flop 288. The use of digital circuitry permits encoding of that write signal and hence of the corresponding signal that enters D flip-flop 288. It is the function of D flip-flop 288 to pass a gated digital signal on to write driver 290, such signal being encoded, if necessary, so as to distinguish the resultant writing within marking field 110 from panel type information that has already been recorded therein as was previously described, and also from sequence data now to be described.

FIG. 2A can be seen to include along base strip 266 a series of marking fields 300, 302, 304, 306, 308, 310 and 312. In this aspect of the invention, base strip 266 is to be considered as a portion of the complete base 262 onto which, instead of color panels 268, 270, 272, there are deposited at the time of manufacture the series of marking fields 300, 302, 304, 306, 308, 310 and 312, together with the panel markers 278a, 278b. Marking fields 300, . . . , 312 comprise magnetically sensitive regions that are deposited in fixed relationships with particular portions of each of color panels 268, 270, 272, e.g., as shown in FIG. 2A, so as to define respective ⅓ regions.

The purposes of marking fields 300, . . . , 312 are (1) to provide sequence numbers corresponding to respective particular absolute positions along ribbon 260, and (2) to accept the writing of usage data thereon by write system 280 as previously described. Upon installation in a printer of a ribbon 260 that has not been provided with the sequence data hereinafter described, in this aspect of the invention microprocessor 222 has been programmed to generate sequence numbers (e.g., digits 1, 2, 3, 4, etc.) and write them into marking fields 300, . . . , 312. (Alternatively, such sequence numbers may have been placed into marking fields 300, . . . , 312 at the time of manufacture of ribbon 260, albeit with a substantial increase in cost of ribbon manufacture.) By establishing such sequence numbers on ribbon 260 itself so as to be readable by read system 240, it is no longer necessary to track the movement of ribbon 260 by counting through microprocessor 222 the number of panel markers 278*a*, 278*b* that have been traversed. (On the other hand, if those sequence numbers are not pre-written at the time of manufacture, panel markers 278*a*, 278*b* must be present at the time the sequence numbers are in fact written onto ribbon 260 within the printer if the beginning of each set of panels is to be identified so that such number marking can be carried out.) A map of such numbers (whether pre-written at the time of manufacture or written by the printer itself as just described) is also provided within memory 224 as a part of the information that characterizes the particular ribbon 260. It is thus known, for example, that marker field "5," which corresponds to marking field 308 in FIG. 2A, is the middle one-third portion of the second (magenta) panel within the first panel set on ribbon 260. (The illustration which relates just three marking fields to each panel is of course exemplary only.)

In the course of using ribbon 260, there will eventually also appear within marking field 208 an indication as previously described that that portion of that particular panel has been used, and hence is no longer available for use. In the process of carrying out an automated printing procedure, in this example microprocessor 222 and memory 224 will then cause ribbon 260 to be moved, when desired, to some other magenta panel or portion thereof. Through the use of marking fields 300, . . . , 312, and of read system 240 and write system 280, it thus becomes possible to utilize all of the printing regions of ribbon 260 more economically, i.e., waste of ribbon 260 is minimized.

It will be understood by those of ordinary skill in the art that other arrangements and disposition of the aforesaid components, the descriptions of which are intended to be illustrative only and not limiting, may be made without departing from the spirit and scope of the invention, which must be identified and determined only from the following claims and equivalents thereof. Thus, it is possible to provide a 20×20 dot matrix mark or the like within the printing portion of ribbon 100 (or 260) by disposing a read head and a write head adjacent to that printing portion and transferring the ink or dye to a platen roll. In such a thermal transfer embodiment, at least the "write head" must become pressed against the ribbon at the time of writing, while the read head can be disposed at any convenient location at which it will have readable access to such writing. Similarly, the sequence numbers to be written as described above can also include in themselves further information such as the panel color. Moreover, in printers such as that described in this inventor's Appl. Ser. No. 08/047,144 filed Apr. 12, 1993 and mentioned above, wherein it is possible to carry out printing separately on the left-hand or right-hand sides of a sheet of substrate, those sequence numbers and usage marks can also indicate on which side of a sheet (and hence of the ribbon) that printing had been conducted.

For the types of document often required that provide mainly text but with a color print inserted into one small area, a high resolution print head for color may be of a smaller size, e.g., 4 inches, while the print head for text may be 8 inches. Since in this case the color image need extend only part way down the substrate, the amount of yellow, magenta and cyan (y, m, c) color ribbon required for each sheet will be less. A narrower y, m, c color ribbon having panels of that smaller longitudinal dimension can be used, or each panel set of a y, m, c color ribbon having larger panels can be used for two or more images.

Figure 3:
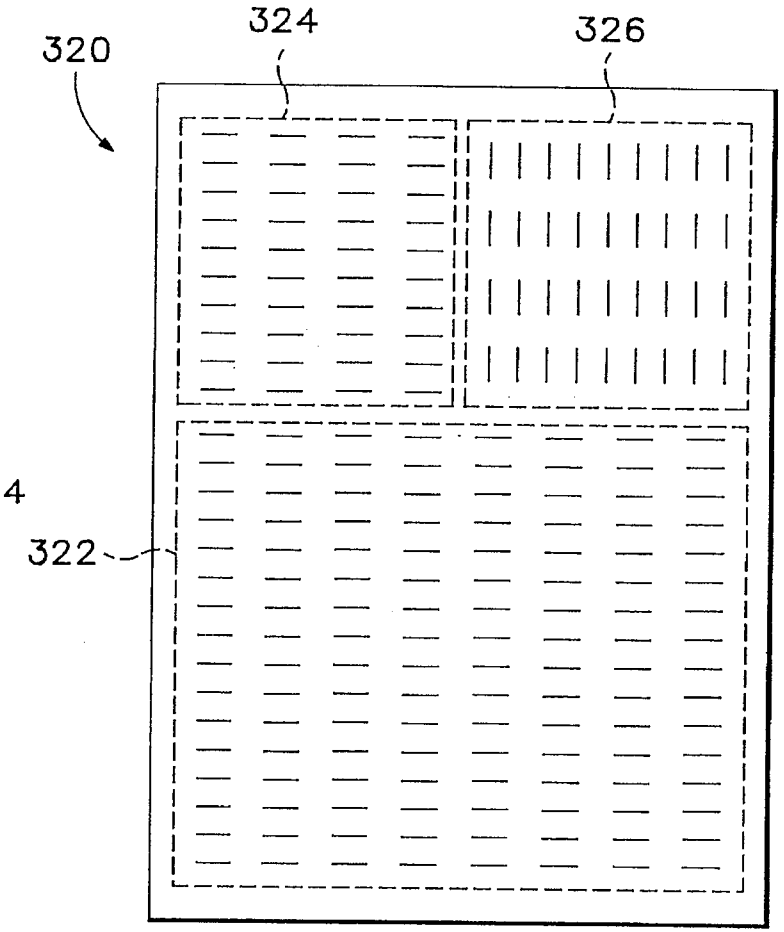
FIG. 3 shows a plan view of a document including text printed in black and a smaller full color image.

A document 320 of the type just described is shown in FIG. 3, in which a first image region 302 comprises text as indicated by the horizontal dashed line, and a smaller second image region 304 in one corner of document 320 and indicated by vertical dashed lines comprises a full color image (e.g., a company logo, or photograph of a person or the like). (The size of second image region 304 relative to that of first image region 322, i.e., approximately one-half of the horizontal dimension of document 320 and one-third of the vertical dimension thereof, is of course only one possible example.) In the upper portion of document 320, first image region 322 extends only part way across document 320, i.e., through the subregion of first image region 322 that is labelled 324 and separated by ghost lines. The text of subregion 324 extends approximately one-half the width and one-third the length of document 320, thereby providing space for second image region 326, while in the lower two-thirds of region 322 the text extends the full width thereof.

Of course, the foregoing description must be regarded as being illustrative only, in that it is not necessary that first and second image regions 322, 326 must be separated: when precise registration is not required and using an appropriately colored panel ribbon as second ribbon for example, second region 326 may be for the purpose of providing highlighting to black text.

Figure 4A:
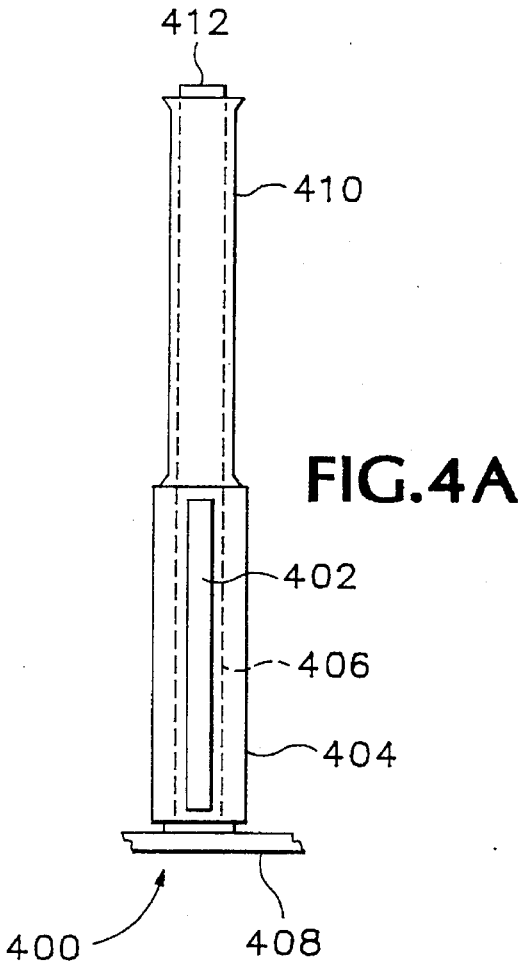
FIG. 4 shows alternative mountings of a relatively shorter print head for printing the smaller full color image of FIG. 3.

Applicant's copending application, Ser. No. 08/047,144, describes a method of printing a document such as that illustrated in FIG. 3 by using multiple print heads, for example where one print head extends across the full width of the document, and a second, narrower print head is provided for printing the color portion 326. Such a print head is illustrated in FIG. 4A as print head 402. Serial No. 047,144 also teaches repositioning the small print head along a shaft 406 for locating it where color printing (where use of an alternative narrow ribbon) is desired.

Figure 4B:
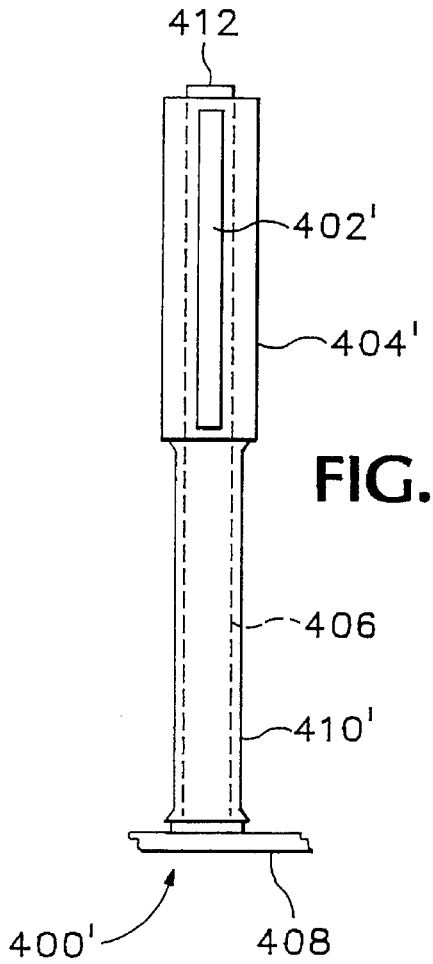

Referring again to FIG. 3, subregion 324 can also be printed by a full width black ribbon just as is region 322, and region 326 can be printed using a full width y, m, c ribbon. However, when using a ribbon for full color printing of a size to encompass the full width of document 320, i.e., of the same size as that used to print the text in first image region 322, to print only the smaller second image region 326 would leave one-half of the width of such a ribbon unused. Ribbon usage can be recorded so that unused portions of a ribbon can be located at a later time for use. In brief, (1) each ribbon panel (and set of which the panel is a member) is identified by a marker, as are distances within each panel; (2) the markers are read by a sensor as the ribbon is transported from roll to roll so that a continuing record is kept of the position of the ribbon; (3) the corresponding periods during which printing was actually carried out are recorded by one of several alternative means; and (4) a microprocessor analyzes those events and has provision for locating unused ribbon portions. Those procedures can also be applied in the present context for recording which transverse portions of a ribbon would have been used, e.g., to print a series of images of the type of second image region 326, so that unused transverse portions of the ribbon can similarly be identified for later use. Thus, if print images of the type of second image region 304, by also recording in which position print head had been placed during such printing, a usage record is obtained that applies only to that portion of the ribbon that was so used, and similarly with respect to other placements of print head 402 (e.g., as shown in FIG. 4B ), so that the ribbon could be used later for printing in other regions.

Figure 5:
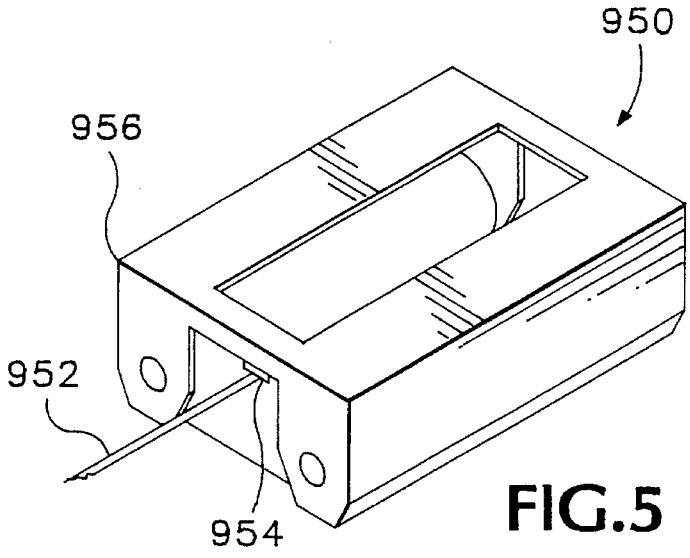
FIG. 5 shows a perspective view of a cassette containing a ribbon and a memory chip for storing ribbon information and usage data.

Cassette system 950 shown in FIG. 5 further comprises cable 952 connected at one end to ribbon control 234 within printer control system 230 and at the other end to memory chip 954 attached to cassette 956. (Cassette 956 contains a ribbon.) The purpose of cassette system 950, and especially of memory chip 954, is to receive data similar to that accumulated by memory 924, as will be hereinafter described, concerning the ongoing usage of the ribbon. Memory chip 954 may comprise any type of non-volatile memory, e.g., as powered by battery (not shown), in order that such accumulated ribbon usage data will not be lost if it becomes necessary to remove cassette 956 from the printer (e.g., for purpose of overnight data security, an exchange of ribbon, or the like).

I claim:

1. A method of reducing wasted ribbon in a non-impact printing system, the method comprising the steps of:

loading an elongate ribbon into the printing system, the ribbon comprising a series of panels of transfer material disposed on one side of a medium;

printing image data in the printing system by using the transfer material at particular locations along the ribbon to transfer an image to a substrate;

determining an actual area of the ribbon used in said printing step;

the actual area of the ribbon used comprising an area from less than a full width of the ribbon up to a full width of the ribbon in a transverse direction;

responsive to said printing step and said determining step, marking the ribbon adjacent said particular locations with usage marks to indicate the actual area of the ribbon used in said printing step;

subsequently reading the usage marks along the ribbon to identify to the printing system which areas of the ribbon remain unused and therefore available for subsequent printing, including unused areas laterally adjacent to used areas of the ribbon; and using the identified unused areas of the ribbon in a subsequent printing step, thereby minimizing wasted ribbon.

2. A method according to claim 1 further comprising defining a series of marking fields at selected locations along the length of the ribbon; and wherein said marking step includes marking the ribbon within each of the marking fields so as to indicate an area of the ribbon in which printing has occurred.

3. A method according to claim 1 wherein said marking step includes applying energy to the ribbon in a form of one of heat, light or a magnetic field.

4. A method of reducing wasted ribbon in a non-impact printing system, the method comprising the steps of:

loading an elongate ribbon into the printing system, the ribbon comprising transfer material disposed on one side of a medium;

providing a memory within the printing system for storing ribbon usage data;

printing image data in the printing system by using the transfer material in a series of locations along the ribbon to transfer an image to a substrate;

for each location along the ribbon in which transfer material was used in said printing step, determining an actual area of the ribbon used in said printing step;

the actual area of the ribbon used comprising an area from less than a full width of the ribbon up to a full width of the ribbon in a transverse direction;

responsive to said printing and determining steps, forming and storing usage data in the memory that identifies the actual areas of the ribbon used in printing;

subsequently reading the usage data to identify to the printing system which areas of the ribbon remain unused and therefore available for subsequent printing, the identified unused areas including areas of the ribbon laterally adjacent the areas indicated as having been used in printing; and using the identified unused areas of the ribbon in a subsequent printing step, thereby minimizing wasted ribbon.

5. A method according to claim 4 further comprising logically dividing the ribbon into left-hand and right-hand areas; and wherein said determining step includes determining for each of said series of locations along the ribbon whether or not each of the left-hand areas of the ribbon has been used.

6. A method according to claim 4 wherein said determining the actual used area of the ribbon includes logically dividing the ribbon into a selected number of transverse portions of arbitrary width.

7. A method of reducing wasted ribbon in a non-impact printing system, the method comprising the steps of:

loading an elongate ribbon into the printing system, the ribbon comprising transfer material disposed on one side of a medium and having a predetermined width;

printing image data in the printing system using the transfer material at a selected longitudinal location on the ribbon to transfer an image to a substrate, the transferred image having a width less than the width of the ribbon;

for the selected longitudinal location, recording ribbon usage data that indicates which transverse portions of the ribbon are used in said printing step, thereby determining an actual area of the ribbon used in the printing step;

the actual area of the ribbon used comprising an area from less than a full width of the ribbon up to a full width of the ribbon in a transverse direction;

subsequently reading the ribbon usage data so that the printing system can identify unused portions of the ribbon at the said longitudinal location; and then using the identified unused portions of the ribbon in a subsequent printing step, thereby minimizing wasted ribbon.

8. A method according to claim 7 wherein said recording step includes marking the ribbon adjacent said longitudinal location with usage marks to indicate which transverse portions of the ribbon were used in said printing step; and said reading step includes reading the usage marks on the ribbon.

9. A method according to claim 7 further comprising providing a memory and wherein said recording step includes storing ribbon usage data in the memory that indicates which transverse portions of the ribbon are used in said printing step; and said reading step includes reading the ribbon usage data from the memory.

10. A method according to claim 9 wherein the ribbon is disposed within a cassette and the memory is disposed within the cassette.

11. A method according to claim 10 wherein the memory means includes means for retaining the ribbon usage data even while the cassette is removed from the printer.

12. A method according to claim 9 wherein the memory means comprises a nonvolatile memory chip.

13. A method according to claim 9 wherein said recording step includes storing sequence numbers corresponding to each of the longitudinal locations along the ribbon.

* * * * *